US006419050B1

(12) United States Patent
Sardonico

(10) Patent No.: US 6,419,050 B1
(45) Date of Patent: Jul. 16, 2002

(54) MOBILE DEVICE FOR DISABLED PERSONS

(75) Inventor: Gennaro Sardonico, Vinovo (IT)

(73) Assignee: Bestgroup SRL, Turin (IT)

( * ) Notice: Subject to any disclaimer, the term of this patent is extended or adjusted under 35 U.S.C. 154(b) by 0 days.

(21) Appl. No.: 09/391,193

(22) Filed: Sep. 7, 1999

(30) Foreign Application Priority Data

Sep. 15, 1998 (IT) ..... T098A0781

(51) Int. Cl.[7] ..... A61G 3/06; A61G 3/02

(52) U.S. Cl. ..... 187/244; 187/200; 187/901; 414/921; 414/663

(58) Field of Search ..... 187/200, 240, 187/242, 243, 244, 284, 291, 901; 414/921, 663, 662, 667, 671, 347, 392, 399, 401, 396, 584, 273

(56) References Cited

U.S. PATENT DOCUMENTS

| | | | | | |
|---|---|---|---|---|---|
| 3,598,265 | A | * | 8/1971 | Aaronson et al. | 414/663 |
| 3,765,692 | A | | 10/1973 | Barber et al. | |
| 3,848,754 | A | * | 11/1974 | Bryntse | 414/662 |
| 3,888,463 | A | * | 6/1975 | O'Brien et al. | 414/921 |
| 4,176,732 | A | * | 12/1979 | Nordskog | 187/244 |
| 4,576,539 | A | | 3/1986 | Williams | |
| 4,787,111 | A | * | 11/1988 | Pacek et al. | 414/921 |
| 4,971,510 | A | | 11/1990 | Houle | |
| 5,105,915 | A | * | 4/1992 | Gary | 187/200 |
| 5,322,408 | A | * | 6/1994 | Wooden | 187/200 |
| 5,328,316 | A | * | 7/1994 | Hoffman | 414/661 |
| 5,499,694 | A | * | 3/1996 | Dorn | 187/200 |
| 5,553,990 | A | * | 9/1996 | Kytola, Sr. | 414/921 |
| 5,595,470 | A | * | 1/1997 | Berkey et al. | 414/921 |
| 6,109,395 | A | * | 8/2000 | Storm | 187/200 |

FOREIGN PATENT DOCUMENTS

| | | | | |
|---|---|---|---|---|
| DE | 93 00 793 | | 5/1994 | |
| DE | 4441929 | A1 * | 5/1996 | |
| FR | 2574773 | A1 * | 6/1986 | 187/244 |
| JP | 5-24795 | A * | 2/1993 | 187/243 |

* cited by examiner

*Primary Examiner*—Eileen D. Lillis
*Assistant Examiner*—Thuy V. Tran

(57) ABSTRACT

Mobile device for disabled persons comprising a trolley carrying a vertically displaceable platform designed to bear a wheelchair. The trolley is motor-driven and is equipped with an aligning system to line-up the platform with respect to an access site of the wheelchair. The platform can also be shifted in a transverse direction relative to the trolley and includes a transfer ramp longitudinally displaceable between a retracted position and an extended position.

5 Claims, 4 Drawing Sheets

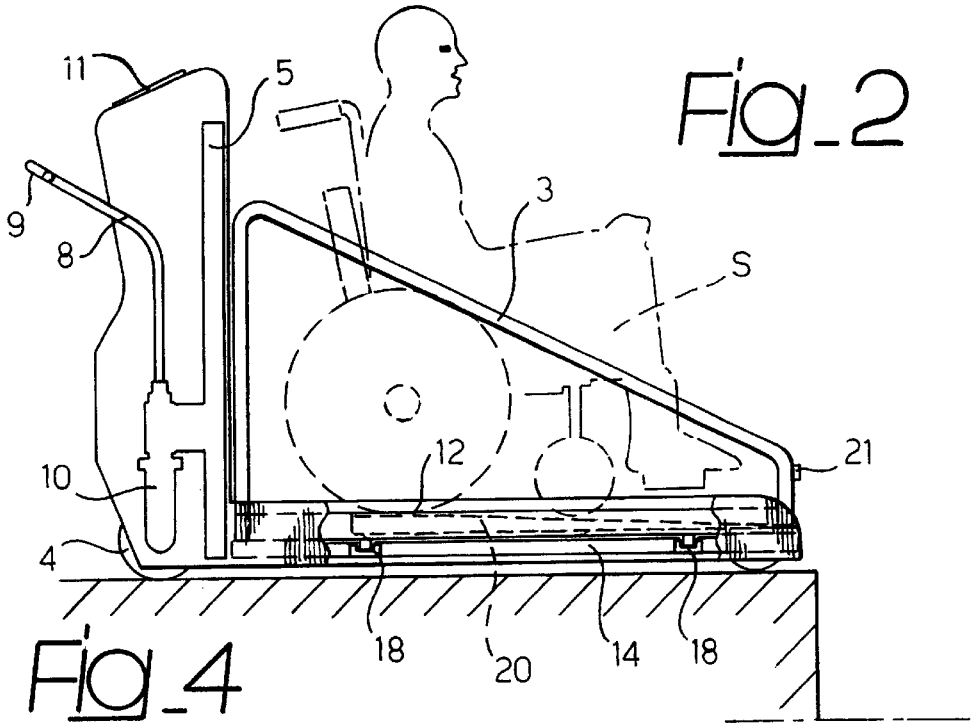
Fig_2
Fig_4
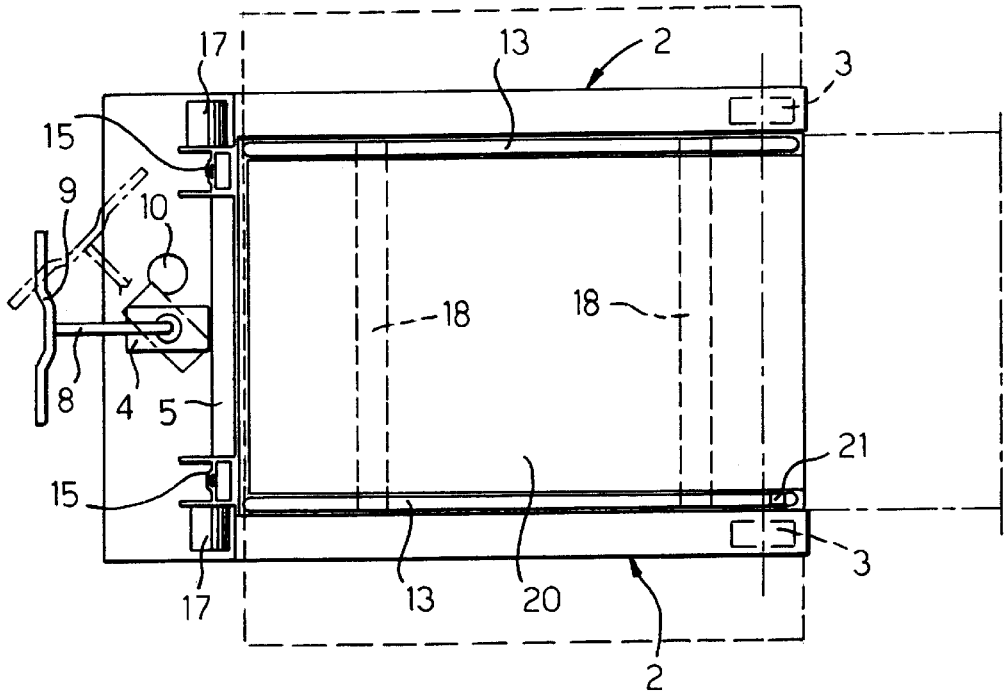

MOBILE DEVICE FOR DISABLED PERSONS

BACKGROUND OF THE INVENTION

The present invention is generally related to handling systems for disabled persons sitting on wheelchairs. More particularly, the invention is directed to a mobile device designed to enable transportation of the disabled person towards an access site, for instance the inlet door of a vehicle, and then his or her transfer to and through said access site, and vice-versa. In the case of a vehicle, for example a railway vehicle, the access site is namely consisting of a door opening arranged at a higher level than the railway station platform. Similar conditions are to be founded even in the case of wheel vehicles and of architectural sites wherein only steps and not shute ramps are provided get over even low level differences.

In all these cases autonomous access of the disabled person on his wheelchair is prevented, and resorting to elevator systems with the aid of assisting personnel is necessarily required.

Such an elevator system, expressly provided for boarding and unboarding a wheelchair relative to the body of a railway vehicle, is disclosed and illustrated in German Patent Application DE-A-4128076. This system consists of a manually displaceable trolley carrying a horizontal platform designed to bear the wheelchair, and lifting means to vertically displace the platform up to the level of the railway body access door.

This known device would seem to provide a limited functional efficiency, particularly owing to the fact that correct aligning of the platform with the narrow door opening of a railway vehicle, so as to enable carrying out the wheelchair boarding and unboarding, requires relatively long operations by the disabled person's assistant, which evidently involves uncomfortableness for the disabled person himself or herself. Due to this reason such a known device does not appear having ever been reduced into practice.

SUMMARY OF THE INVENTION

The object of the present invention is to overcome the above drawbacks, and to provide a mobile device for disabled persons of the type set forth in the above, which is effectively suitable for effective employ in all the above disclosed situations, and having nevertheless a relatively simple and economical construction.

According to the invention, this object is achieved essentially by virtue of the fact that the trolley is motor-driven and is provided with an aligning system to line-up the platform relative to an access site for the wheelchair.

This aligning system conveniently comprises optical detector means carried by the platform and arranged to co-operate with optical locator means to be associated to said access site.

According to a further feature of the invention the platform may be displaceable not only vertically but also horizontally in a transverse direction with respect to the trolley, and may additionally include a transfer ramp longitudinally displaceable between a retracted position and an extended position for transferring the wheelchair from the platform to the access site and vice-versa.

The trolley of the mobile device according to the invention can be motor-driven not only as far as advancement thereof is concerned, but even in connection with lifting and/or transverse displacement of the platform and/or longitudinal displacement of the transfer ramp. In this case the aligning system may conveniently comprise an electronic control unit connected to said optical detector means and to motor-actuators of the trolley to perform positioning, automically and according to a guided aligning cycle, said platform with the related transfer ramp into precise correspondence with the access site for the wheelchair.

Accordingly the assisting operator shall simply have to drive the trolley until approximatively locate it in front of the access site, and then starting the automatic aligning cycle simply checking that this cycle is correctly completed until transfer of the wheelchair from the platform to the access site, or vice-versa.

BRIEF DESCRIPTION OF THE DRAWINGS

The invention will now be disclosed in detail with reference to the accompanying drawings, purely provided by way of non-limiting example, in which:

FIG. 2 is a diagrammatic lateral elevational view of the device showing the platform in a lowered position and the transfer ramp in a retracted position, FIG. 4 is a top plan view of FIG. 2.

DETAILED DESCRIPTION OF THE INVENTION

Figure 1:
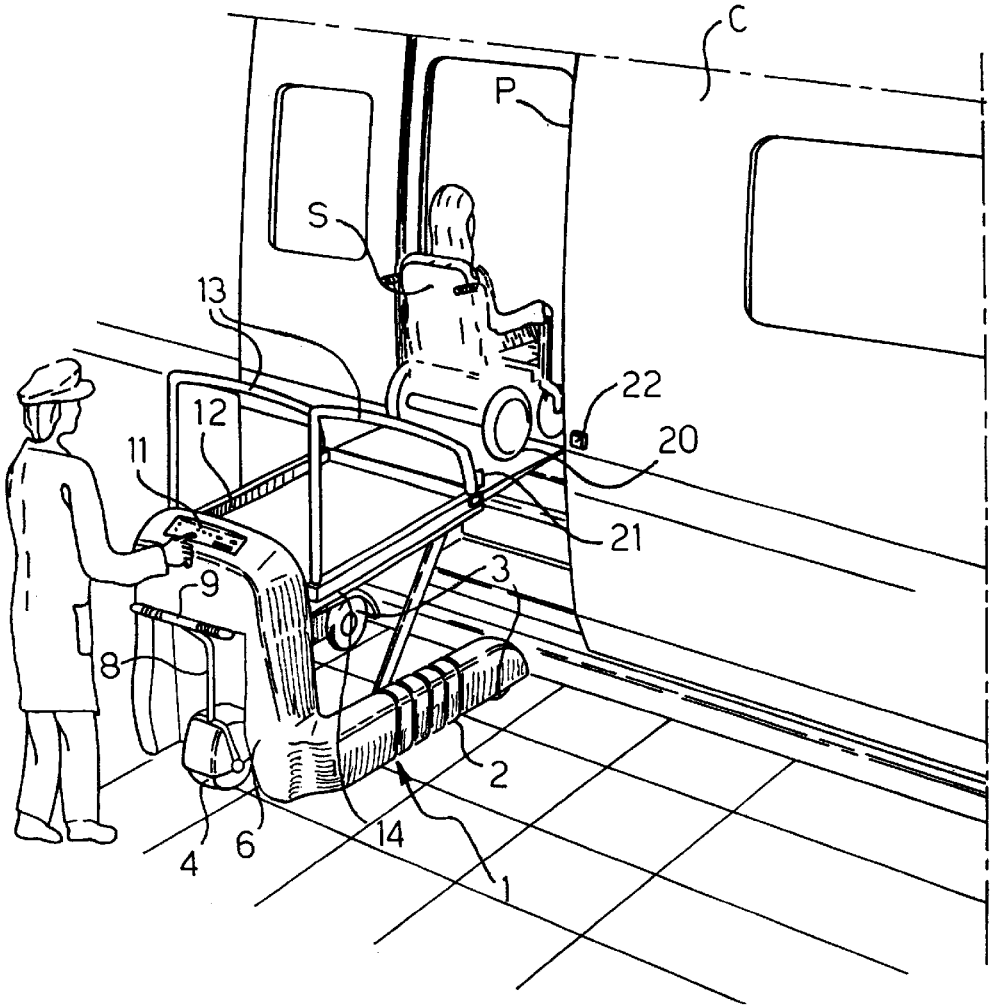
FIG. 1 is a diagrammatic perspective view showing a mobile device for disabled persons according to the invention in one possible example of practical application.

In the case of the shown embodiment, the mobile device for disabled persons according to the invention is essentially constituted by a tricycle trolley comprising a substantially U-shaped frame 2 having two front idle wheels 3 and a rear wheel 4 arranged in correspondence of the central area of a rear wall 5. The frame 2 and the rear wall 5 are conveniently housed within a fairing 6 which, for the sake of simplicity of illustration, is partially omitted in FIGS. 2–6.

The rear wheel 4 is a steering and motor-driven wheel: to such effect it is carried by a fork 7 connected by a rod 8 to a driving handlebar, and to which a motor 10 is operatively associated. The motor 10 may be an electrical or an hydraulic motor, and is operable through a check panel 11 (FIG. 1) to perform forward and rearward motion as well as braking of the trolley 1.

The frame 2 of the trolley 1 carries a horizontal platform 12 designed to bear a wheelchair S. The platform 12, which is conveniently provided with a pair of banisters 13, is vertically displaceable with respect to the trolley 1 between a completely lowered position, shown in FIGS. 2, 4 and 6, and a raised position shown in FIGS. 1, 3 and 5. To this effect, the platform 12 is for instance supported by a base plate 14 which is slidably connected in the back to vertical guides 15 of the rear wall 5 of the frame 2, and is supported inferiorly by swinging arms 16. Vertical displacement of the base plate 14 may be operated manually or, more conveniently, in a motor-driven fashion with the aid of electrical motors 17. Naturally this arrangement is purely indicative, since the connection between the frame 2 and the base plate 14 may be performed through pantograph and the like systems, and motorization thereof may be in alternative hydraulic.

Figure 6:
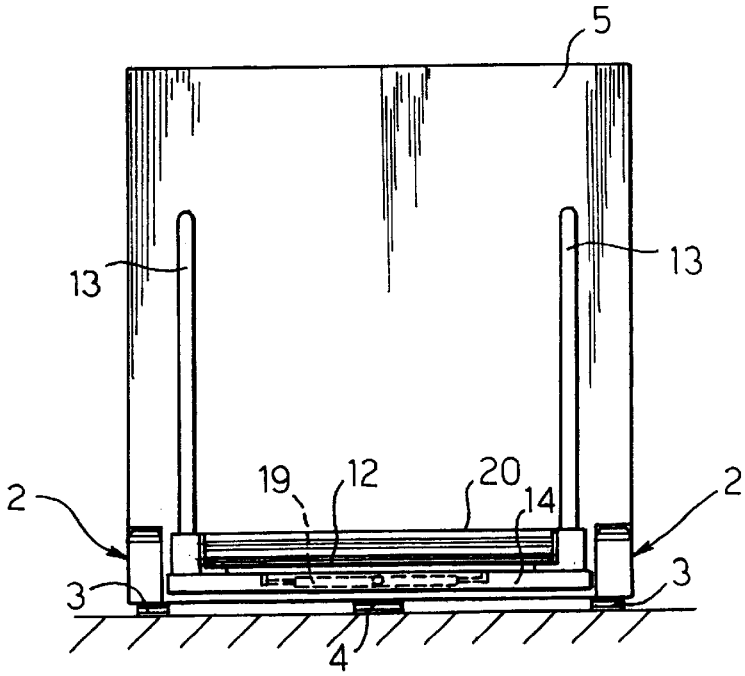
FIG. 6 is a front elevational view of FIG. 3.

The platform 12 is connected to the base plate 14 in a horizontally slidable fashion along a transverse direction: accordingly the platform 12 is coupled to the base plate 14 by means of transverse guides 18, and transverse motion thereof can be operated manually and, more conveniently, in a motor-driven fashion by means of an electrical or hydraulic actuator generally designated as 19 in FIG. 6.

Figure 3:
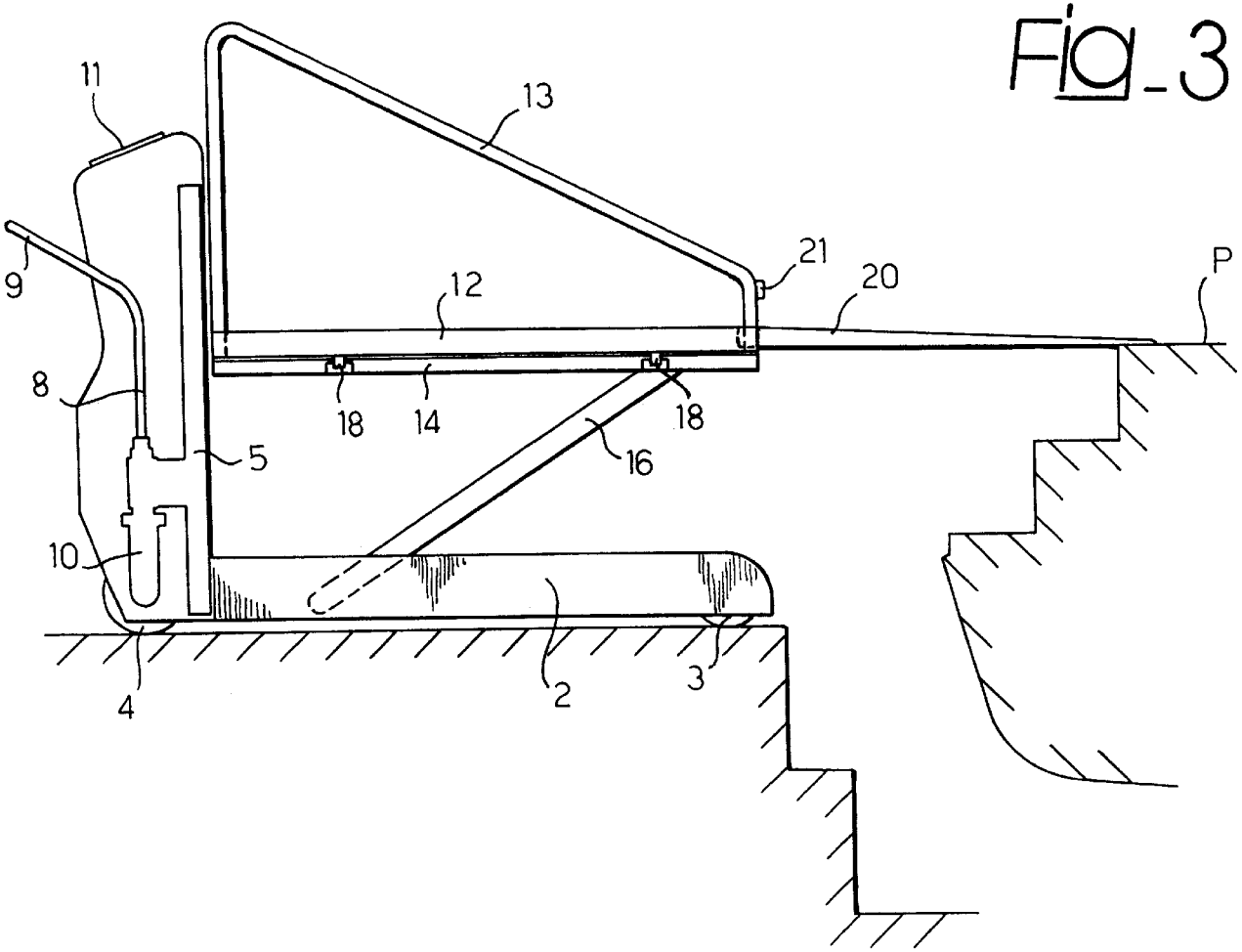
FIG. 3 is a view same as FIG. 2 showing the platform in a raised position and the transfer ramp in an extended position.
Figure 5:
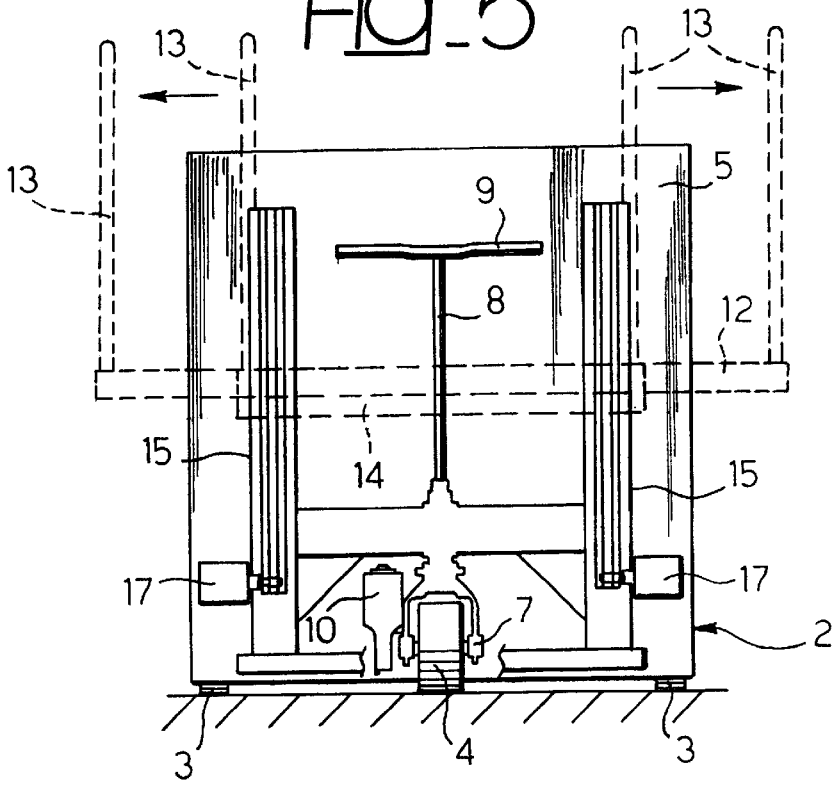
FIG. 5 is a rear elevational and simplified view of FIG. 3.

Moreover a movable transfer ramp 20 is coupled to the platform 12, which is longitudinally displaceable with respect to the platform 12 between a retracted position, shown in FIGS. 2, 4 and 6, and an extended or advanced position shown in FIGS. 1, 3 and 5, in which it is projecting on the prolongation of the platform 12. Displacement of the transfer ramp 20 can be operated manually or, more conveniently, in a motor-driven fashion with the aid of an electrical or hydraulic motor not shown in the drawings.

According to another peculiar feature of the invention, the trolley 1 is provided with an aligning system designed to centre the platform 12 with respect to an access site of the wheelchair S carried thereby. This aligning system includes an electronic check unit 11 operatively connected on one hand to the motor-driven actuators disclosed in the above, intended to displace the platform 12 vertically and transversely and to shifting longitudinally the transfer ramp 20, and on the other hand to an optical detecting assembly. This optical detecting assembly may for instance comprise at least one photoelectric passing-through-beam switch including a photo-transmitter 21 secured to the front area of the platform 12 and a photo-receiver 22 adapted to be applied in immediate proximity of the access site of the wheelchair S. In an alternative embodiment the photoelectric switch may be replaced by a bar-code reader. In any case the optical detecting assembly shall more conveniently comprise at least a pair of sensors designed one to determine the height and the position of the platform 12 in the transverse direction, and the other to reveal the amount of forwardly displacement of the transfer ramp 20.

The aligning system disclosed in the above is connected to the check panel 11 by means of which operation thereof can be started to position automatically and according to a guided aligning cycle the platform 12 in precise correspondence with the access site for the wheelchair S, and thus transfer thereof towards this access site following advancement of the ramp 20.

Naturally the trolley 2 is equipped with a source of electrical power including batteries, not shown in the drawings, and safety devices of a generally conventional type may further be provided to control the above disclosed motor-driven actuators.

FIG. 1 shows one possible application of the mobile device according to the invention, consisting of boarding/unboarding a disabled person sitting on a wheelchair S relative to the access door P of a railway vehicle body C, within the environment of a railway station.

With reference to this application, the boarding cycle of the disabled person is carried out as follows.

After loading the wheelchair S onto the platform 12 placed in its lowered position, and after locking in a convention fashion the wheelchair S as well as the disabled person thereon by means of proper safety belts, the assisting operator proceeds to transfer the trolley 1 towards the body C controlling the motor 10 through the check panel 11, and steering of the rear wheel 4 by means of the handlebar 9. The operator then positions the trolley roughly in front of the access door P, stopping in that position. Then acting on the check panel 11, the operator starts the automatic aligning cycle according to which the platform 12 is raised and if necessary transversally shifted until positioning it into precise alignment with the base of the access door P, this position being detected by the optical detecting system 21–22. Then the transfer ramp 20 is extracted and advanced until bearing onto the base of the access door P, thus allowing passing through of the wheelchair S towards the inside of the body C. Unloading of the wheelchair S is evidently performed carrying out the above disclosed steps in a reversed way.

As previously clarified motorization of the platform 12 and of the transfer ramp 20 is optional, since operating thereof might also be carried out manually.

Furthermore, while employ of the device according to the invention has been disclosed with specific reference to boarding/unboarding a disabled person relative to a railway vehicle body, it is to be pointed out that the device can be equally advantageously used in all cases a disabled person on a wheelchair needs to be transferred from a lower backward area to an upper advanced area, and vice-versa.

Naturally the details of construction and the embodiments may be widely varied with respect to what has been disclosed and illustrated without thereby departing from the scope of the present invention such as defined in the appended claims.

What is claimed is:

1. A mobile device for disabled persons, comprising a trolley carrying a horizontal platform designed to bear a wheelchair and lifting means to vertically displace said platform with respect to trolley, said trolley being motor-driven and further provided with an aligning system to line-up said platform relative to an access site for said wheelchair, wherein said platform is further horizontally displaceable in a transverse direction relative to the trolley.

2. Device according to claim 1, further comprising a transfer ramp carried by said platform and longitudinally displaceable relative thereto between a retracted position and an extended position.

3. Device according to claim 1, wherein said aligning system includes optical detector means carried by the platform and co-operating optical locator means to be associated to said access site.

4. Device according to claim 3, further comprising motor-driven actuator means to operate displacement of said platform along said transverse direction.

5. Device according to claims 3, wherein said lifting means of said platform comprise motor-driven actuators means.

* * * * *